US012637783B2

(12) United States Patent
Sarsanedas Gimpera et al.

(10) Patent No.: US 12,637,783 B2
(45) Date of Patent: May 26, 2026

(54) ELECTROLYTIC MEDIUM FOR ELECTROPOLISHING AND METHOD OF ELECTROPOLISHING WITH SAID MEDIUM

(71) Applicant: DRYLYTE, S.L., Barcelona (ES)

(72) Inventors: Marc Sarsanedas Gimpera, Olot (ES); Guiomar Riu Perdrix, Barcelona (ES); Joan Roa Rovira, Tarragona (ES)

(73) Assignee: DRYLYTE, S.L., Barcelona (ES)

( * ) Notice: Subject to any disclaimer, the term of this patent is extended or adjusted under 35 U.S.C. 154(b) by 219 days.

(21) Appl. No.: 18/641,790

(22) Filed: Apr. 22, 2024

(65) Prior Publication Data

US 2024/0271315 A1 Aug. 15, 2024

Related U.S. Application Data

(63) Continuation of application No. PCT/ES2022/070649, filed on Oct. 14, 2022.

(30) Foreign Application Priority Data

Oct. 20, 2021 (ES) ..... ES202130985

(51) Int. Cl.
*C25F 3/16* (2006.01)
*C23F 1/10* (2006.01)
*C25F 7/00* (2006.01)

(52) U.S. Cl.
CPC ..... *C25F 3/16* (2013.01); *C25F 7/00* (2013.01); *C23F 1/10* (2013.01)

(58) Field of Classification Search
CPC ..... C25F 3/16
See application file for complete search history.

(56) References Cited

U.S. PATENT DOCUMENTS

| | | | |
|---|---|---|---|
| 3,523,834 | A | 8/1970 | Hewins |
| 3,533,928 | A | 10/1970 | Inoue |
| 3,776,827 | A | 12/1973 | Inoue |
| 4,522,692 | A | 6/1985 | Joslin |

(Continued)

FOREIGN PATENT DOCUMENTS

| | | | |
|---|---|---|---|
| CN | 109735891 | A | 5/2019 |
| EP | 3372711 | A1 | 9/2018 |

(Continued)

OTHER PUBLICATIONS

International Search Report, PCT/ES2022/070649, Dec. 19, 2022, 6 pages.

(Continued)

*Primary Examiner* — Brian W Cohen
(74) *Attorney, Agent, or Firm* — Edell, Shapiro & Finnan, LLC

(57) ABSTRACT

Electrolytic medium for electropolishing and electropolishing method using the electrolytic medium. The electrolytic medium includes solid particles retaining therein a water. Covering each of the solid particles that retains the water is an electrically non-conductive immiscible liquid. The non-conductive immiscible liquid is displaceable on the solid particles to allow electrical conductivity between solid particles that contact one another and to allow electrical conductivity between the solid particles and the workpiece upon the solid particles contacting the surface of the workpiece.

20 Claims, 3 Drawing Sheets

(56) References Cited

U.S. PATENT DOCUMENTS

| | | | |
|---|---|---|---|
| 10,683,583 | B2 | 6/2020 | Sarsanedas Millet |
| 10,975,491 | B2 | 4/2021 | Sarsanedas Millet |
| 11,970,632 | B2 | 4/2024 | Sarsanedas Millet et al. |
| 2001/0002034 | A1 | 5/2001 | Reichardt et al. |
| 2002/0077035 | A1 | 6/2002 | Wang et al. |
| 2008/0006707 | A1 | 1/2008 | Nobili |
| 2010/0025852 | A1 | 2/2010 | Ueki et al. |
| 2024/0102197 | A1* | 3/2024 | Sarsanedas Gimpera ..... C25F 3/16 |

FOREIGN PATENT DOCUMENTS

| | | | |
|---|---|---|---|
| ES | 2754876 | A1 | 4/2020 |
| ES | 2756948 | A1 | 4/2020 |
| ES | 2860348 | A1 | 10/2021 |
| GB | 1406081 | A | 9/1975 |
| RU | 2694941 | C1 | 7/2019 |
| RU | 2697757 | C1 | 8/2019 |
| RU | 2699495 | C1 | 9/2019 |
| RU | 2710086 | C1 | 12/2019 |
| WO | 99/10569 | A1 | 3/1999 |

OTHER PUBLICATIONS

V. Palmieri, V. "Fundamentals of Electrochemistry—the Electrolytic Polishing of Metals: Application to Copper and Niobium", Proceedings of the 11th Workshop on RF Superconductivity, Lübeck/Travemünder, Germany, 2003, 9 pages.

Jiayin Yuan, et al., "Poly(ionic liquid)s: Polymers expanding classical property profiles", Polymer 52 (2011) 1469 e 1482, 2011, 14 pages.

Binghao Wang, et al. "High-k Gate Dielectrics for Emerging Flexible and Stretchable Electronics", Chemical Reviews 2018, V118 Issue 11, 5690-5754, 2018, 65 pages.

"Journal Of Chromatography, Including Electrophoresis and Other Separation Methods", vol. 602, Nos. 1 &2, Jun. 5, 1992, pp. 1-150.

"Journal Of Chromatography, Including Electrophoresis and Other Separation Methods", vol. 602, Nos. 1 &2, Jun. 5, 1992, pp. 151-294.

* cited by examiner

ELECTROLYTIC MEDIUM FOR ELECTROPOLISHING AND METHOD OF ELECTROPOLISHING WITH SAID MEDIUM

CROSS-REFERENCE TO RELATED APPLICATIONS

This application relates to and claims the benefit and priority to International Application No. PCT/ES2022070649, filed Oct. 14, 2022, which claims the benefit and priority to Spanish Application No. P202130985, filed Oct. 20, 2021, each of which is incorporated herein by reference in its entirety.

FIELD

The field of application of the present invention falls within the industrial sector of surface treatments, especially the electropolishing of conductive surfaces, with direct application in the industrial sector of cutting and drilling tools, without limitation to its application in diverse sectors such as, for example, medical, aeronautical, dental, automotive, among many others.

BACKGROUND

Inorganic composite materials such as metal-metal, ceramic-ceramic, metal-ceramic are of high industrial relevance. They present several phases, with different physical, chemical, mechanical, and electrochemical properties. When the surfaces of these materials are to be polished by conventional electropolishing, the different phases are not attacked in the same way (producing a selective chemical attack in some phases) and at the same speed, leading to irregularities and technical problems under service conditions.

One of the most industrially relevant inorganic composite materials is cemented carbide, also known as hard metal, vidia "widia in German", metallic carbide, tungsten carbide, cemented carbide, among others. It is a composite material with a heterogeneous distribution of hard ceramic particles of tungsten carbide (WC) providing to the final material high hardness and high wear resistance. These hard ceramic particles are embedded in a metallic cobalt (Co) matrix, improving its fracture toughness.

Due to all of the aforementioned reasons, and because of the fact that as a whole, it is a temperature resistant material, it is useful in cutting and drilling tools, such as radial discs, drill bits, punches, dies, tooling, etc. In its commercial use, both WC—Co (also known as nude in English) is as well used as a substrate for coatings where a material presenting low surface roughness is required for avoiding unnecessary wear and increasing its lifespan in the working conditions. Due to the extreme hardness of WC, it is a difficult material to polish by means of abrasion. When attempting to polish this material chemically or electrochemically, because of the differences in electrochemical and mechanical properties between the ceramic particles with respect to the metallic binder, the polishing is not homogeneous, producing different polishing levels between both constituents. Likewise, due to the pH of the polishing liquid or the medium used in the electrochemical process, a selective attack is produced on the metallic binder, completely dissolving the intersection between different layers on the surface of the material to be polished. This phenomenon is known as "leaching" and produces a considerable reduction in its mechanical properties and therefore in the performance and live span of the WC—Co under working conditions.

Other inorganic ceramic-metal composite materials present the same problem, such as (Ti,Ta)WC—Co, (C,N)Ti—FeNi, among others. Therefore, due to all aforementioned reasons, there is an industrial need for a surface treatment that allows a polishing process for cemented carbide, and other similar inorganic ceramic-metal composite materials, while keeping their physical, chemical, and mechanical properties unchanged on its surface.

Recently, the same applicant has developed a new dry electropolishing technology using an electrolytic medium composed of solid electrolyte particles in a gaseous environment (ES201630542). This allows obtaining results with low roughness and specular finishes. The particles used in this process comprise a polymer that retains a conductive acidic solution, for example: hydrofluoric acid (ES201630542), sulfuric acid (ES201830074), sulfonic acids (ES201831092), or hydrochloric acid (ES201831093), each suitable for polishing different metals.

However, these compositions have several limitations. First, the particles generate acidic exudates on the metal surface which, along with atmospheric oxygen, cause uncontrolled oxidations, marks, and pitting. Second, the medium behaves like a granular material, having limited mobility, and high mechanical resistance, preventing mechanically week or fragile parts from being polished. Third, in metal-ceramic inorganic composite materials, for example, tungsten carbide, there is preferential removal of the metallic binder near the surface (leaching).

Solutions to these limitations for an expert in the field may include varying the electrical parameters of the electropolishing process or reducing the acidic concentration. In other words, reducing the acidity of the medium. This may represent a partial improvement for some of these limitations; however, it does not represent any qualitative improvement.

Hence, there is an industrial need for a new method and an efficient electrolytic medium for dry electropolishing of inorganic composite materials, with particular relevance for tungsten carbide metal-ceramic material.

This invention solves the problem of electropolishing composite materials inorganic composite materials, including conductor metal-metal, ceramic-ceramic, and metal-ceramic. These materials have multiple phases with different physical, chemical, mechanical, and electrochemical properties. In conventional electropolishing, the different phases are not attacked at the same rate, leading to varying local roughness between the constituents and therefor present technical issues under service conditions.

Dry electropolishing using solid electrolyte particles presents several limitations, such as the generation of exudates and the lack of movement of the granular material, limiting its use in inorganic composite materials.

SUMMARY

Disclosed is a new electrolytic medium and method to achieve homogeneous surface treatment of the different constituents of inorganic composite materials, obtaining planarity (submicrometric order of roughness) without causing localized corrosion. Therefore, this invention aims to overcome the limitations of current dry electropolishing methods.

The invention refers to an electrolytic medium for electropolishing and to a method for electropolishing with said medium, providing advantages and features described in detail below and which represent an improvement over what is currently known.

The object of the present invention lies on an electrolytic medium and a method for electropolishing conductive metal-metal, ceramic-ceramic and metal-ceramic inorganic composite materials by means of said medium, allowing to provide a homogeneous removal of the different constituents of inorganic composite materials to achieve flatness and leveling among them (submicrometric order of roughness) and without producing localized corrosion in any of its constituents.

BRIEF DESCRIPTION OF THE DRAWINGS

To complement the description being provided and for a better understanding of the characteristics of the invention, some drawing sheets are included as an integral part of it. They are illustratively and not imitatively. The following aspects are represented.

DETAILED DESCRIPTION

Figure 1A:
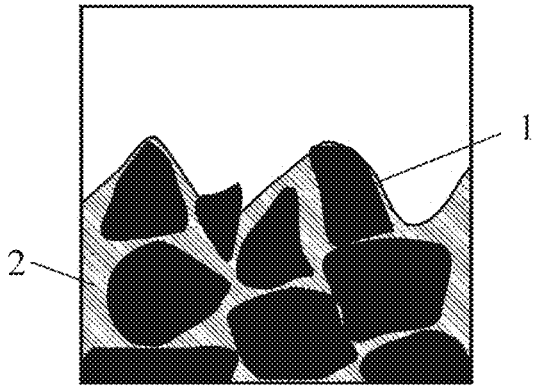
FIG. 1A is a schematic representation of a metal-ceramic composite material with a certain initial roughness before a polishing process.

The present invention relates, on one hand, to an electrolytic medium applicable for electropolishing and, on the other hand, to a method for electropolishing inorganic composite materials using said solid electrolytic medium.

The electrolytic medium for electropolishing of conductor metal-metal, ceramic-ceramic, and metal-ceramic inorganic composite materials, in one embodiment, comprises:

A set of solid particles with the capacity to retain liquid,

An amount of water retained in the solid particles, and

A non-conductive immiscible liquid covering the solid particles, so that when two solid particles come into contact or when a solid particle comes into contact with the piece to be polished, the non-conductive liquid moves, allowing charged elements to be exchanged between solid particles or between the solid particle and the piece to be polished.

The non-conductive and/or immiscible liquid covering the particles having the potential to cause more concentrated and stronger aqueous bridges established between two contacting particles or between a particle and the piece to be polished. Thus, the invention's electrolytic medium does not produce acidic exudates or preferential attack on the metallic binder because the electrochemical activity is highly restricted for various reasons, such as the nearly neutral nature of the involved liquids and/or the protective effect of the non-conductive immiscible liquid on the surface to be polished, thereby preventing corrosive effects.

The electrolytic medium restricts the effect to smaller areas of polymer-surface contact (and produced exudates), increasing the degree of geometric selectivity on roughness peaks.

Moreover, the non-conductive immiscible liquid on the surface of the solid electrolyte particles improves the mobility of the granular material and, unexpectedly, does not block conductivity flow between solid electrolyte particles.

Since an intrinsically aggressive liquid is not retained within the solid particle, the solid particle with aqueous liquid contained inside, acts as a polyelectrolyte, ensuring the electrical conductivity and chemical activity of the electrolytic medium.

In summary, this invention restricts the chemical, conductive, and geometric activity of solid electrolyte particles to achieve high levels of selectivity and to polish complex systems like inorganic composite materials. The amount of non-conductive immiscible liquid relative to the number of particles determines the state of the electrolytic medium. Two extreme situations are detailed below, but any intermediate situation can be used.

In one scenario, the electrolytic medium contains the minimum amount of non-conductive immiscible liquid necessary to cover the surface of the particles. Thus, the medium behaves like granular material with air (or another gas) in the interstitial space between particles. This granular electrolytic medium has the advantage of high mobility due to the lubricating effect of the non-conductive immiscible liquid. Additionally, upon a contact with the surface to be polished, such surface is also coated and protected by the non-conductive immiscible liquid.

At the other extreme scenario, the electrolytic medium contains an amount of non-conductive immiscible liquid higher than necessary to fill the interstitial space between particles, thus behaving like a fluid. This medium is easier to move and transport using liquid pumping systems. By having a greater amount of non-conductive and/or non-miscible liquid, a greater protection of the surface to be polished is ensured.

In some embodiments, the non-conductive liquid partially coats the piece to be polished. The non-conductive liquid, coating the metal surface to be polished, is accumulated preferably in the cavities and valleys, protecting the surface and preventing pitting.

In a particular embodiment, the non-conductive immiscible liquid is a liquid silicone. Silicones are non-conductive, thermally stable, and chemically inert, making them suitable for this use. Additionally, silicones are available in a wide range of viscosities, with many possibilities for an adequate selection of the appropriate viscosity depending on the different possible applications.

In this text, voltage, potential difference, and tension are used synonymously to define the same concept.

Below, the characteristics of each constituent of the described solid electrolytic medium are described.

Solid Particles:

The solid particles are made of a material that must retain liquid, regardless of the retention mechanism: porosity, permeation, absorption, interlayer adsorption, capillarity, etc.

In the case where porosity is the retention mechanism, it can be of any range, including microporosity, mesoporosity, macroporosity, fractal porosity, etc.

The solid particles can be ceramic, polymeric, organic, inorganic, of plant origin, etc.

Preferably, the conductive particles are of ion exchange resin, as it promotes ionic conductivity among other features. More preferably, the particles are of cationic exchange resin, as this allows them to capture metal ions extracted in electropolishing processes and maintain their initial properties.

Usually, ion exchange particles with macroporosity are called macroporous particles and those with microporosity are called gel-type particles. Both types are suitable for use in this invention.

Preferably, the particles have a maximum liquid retention capacity between 40 and 70% of water mass relative to total mass of the particle containing the water.

The functional groups present in the exchange resin can be cation exchange such as sulfonic/sulfonate acid, carboxylic/carboxylate acid; anion exchange such as amine/ammonium, quaternary ammonium; or chelating type such as iminodiacetic, aminophosphonic, polyamine, 2-picolylamine, thiourea, amidoxime, isotiouronium or bispicolylamine, as these groups are suitable for ion capture and contribute to electropolishing. The base polymer can be a polymer based on monomers such as styrene and derivatives, divinylbenzene, acrylate type, methacrylate and derivatives with different functional groups, or phenolic resins, among others. Preferably, the solid particles are resins of a copolymer of styrene and sulfonated divinylbenzene, either with a gel-type structure, macroporous structure or other, as they are able to capture ions and have good electrical, chemical and mechanical stability.

When the electrolytic medium is used during an electropolishing processes, the material transmission occurs at the particle/surface contact points, that is, only at the roughness peaks of the surface. Therefore, it is possible to adjust the effect of the electrolytic medium by the shape of the particles.

The particles must be able to flow over the surface of the workpiece to produce a homogeneous effect over its entire surface. A shape promoting the particle movement across the surface to be treated, in a general way, is spherical. Preferably, the particles are substantially spheres or with a quasi-spherical geometry, as this facilitates their rolling over a wide variety of geometries. Preferably, the set of spheres has a central value of diameter distribution between 50 micrometers and 1 mm. By geometry, this measure favors the elimination of roughness inherent to tool machining.

It is possible to use a set of spheres with a bimodal particle size distribution to obtain the high-speed material removal provided by large particles and the detail polish provided by smaller particles.

Depending on the geometry of the surface to be polished, it may be useful to use other shapes that better adapt to a particular need. Such as discs, cylinders, bars, fibers, cones, pointed shapes, etc.

Commercially available cationic exchange resin spheres of poly(styrene-divinylbenzene) sulfonated gel or macroporous type are preferred for this invention.

Solid electrolyte particles retain a certain amount of water. The retained water is responsible for dissolving oxides and salts that form on the surface to be polished during the electropolishing process. In addition, the combination of water and particles is responsible for the electrical conductivity connection, probably through an ionic transport mechanism.

Before preparing the electrolytic medium, preferably, the solid particles with the ability to retain liquid are washed with distilled water and partially dried so that they can retain a conductive liquid. After this process, the particles maintain a certain amount of water, retained in the electrolyte solid particles, so that after this process, the particles do not leak the retained conductive water.

Preferably, ion exchange resin particles retain an amount of water between 10 and 50% of water mass relative to total mass of the resin containing the water, ensuring that there is enough liquid to produce a solubilizing of the possible produced salts.

The water retained in the particles can come from a particle cleaning process. That is, a set of particles with the ability to retain liquid is subjected to a washing process including a final washing step with water. Preferably, the water used in the washing process is distilled water with a conductivity below 10 μS/cm. This low conductivity of the washing water keeps the electrochemical process under control.

Non-Conductive and/or Non-Miscible Liquid:

The main characteristic of this liquid is that it is not electrically conductive. Since it is involved in electrochemical processes, it must exhibit high chemical and thermal stability, due to the predictable high localized temperatures during the electropolishing process. Additionally, the liquid must be immiscible in water to prevent mixing or diffusion with the water retained in the particles. Furthermore, this non-conductive liquid must remain in a liquid or fluid state within the working range. As the process involves distilled water, the working range is, at most, between 0 and 100° C. Preferably, the working range is between 0 and 60° C.

As the solid particles behave like a granular material, it is convenient for the non-conductive liquid to act as a lubricant.

Non-conductive liquids that can be used in this application include, but are not limited to, aliphatic and/or aromatic hydrocarbons, silicones, organic solvents, fluorinated solvents, among others.

Due to their properties of electrical, chemical, and thermal stability, silicones are preferred for this application.

Liquid silicones exhibit high thermal and chemical stability, as well as acting like electrical insulators, and in addition, they have good lubricating properties. These characteristics make them an excellent candidate for this application. All mentioned characteristics contributes on obtaining the desired effect in the solid electropolishing processes of the present invention.

In this text, silicone is understood broadly to encompass all possible compounds, oligomers, or polymers comprising the siloxane group, general formula [—OSiR2-]n, whether linear, branched, or cyclic. The group R is preferably a hydrocarbon group, such as, for example without limitation, methyl, ethyl, n-propyl, iso-propyl, tert-butyl, n-hexyl, cyclohexyl, phenyl, among others.

A particular interesting group of liquid silicones are those comprising poly(dimethylsiloxane), as they present low viscosity and non-toxicity. Specially, liquid silicones with lower viscosity can be used, with a dynamic viscosity of less than 20 cP, preferably in the range of 1 to 10 cP at 25° C.

Cyclic liquid silicones such as octamethylcyclotetrasiloxane D4, decamethylcyclopentasiloxane D5, or dodecamethylcyclohexasiloxane D6, can be used due to their good solvent properties. Because of their volatility, cyclic silicones are preferably used in low-temperature applications.

The amount of silicone added to the particles may vary depending on the dimensions and shape of the workpiece to be polished. For surfaces with cavities and corners, causing low particle mobility in the polishing surface, better results are achieved with higher proportions of silicone.

On the other hand, as mentioned above, a second aspect of the present invention refers to a dry electropolishing method with the described electrolytic medium.

The described electrolytic medium alone is not sufficient to produce a satisfactory electropolishing effect on inorganic composite materials. The electrolytic medium is complemented by a method, especially with the type of current or electrical parameters applied, for obtaining optimal results.

Inside a container 20 the electropolishing method comprises the following steps: Step A—Providing electrical connectivity with a power source 10 to a surface of a workpiece 16 and the electrolytic medium (solid particles 14 containing water and covered by a non-conductive immiscible liquid 30) with an electrode 18, a first pole 11 of the power supply 10 being coupled to the electrode 18 and a second pole 12 of the power supply 10 being coupled to the workpiece; Step B—Bringing the workpiece surface in contact with an electrolytic medium; Step C—Producing relative movement between the workpiece surface and the solid electrolyte particles; Step D—Applying one or more potential differences between the workpiece surface and an electrode connected to the power source, such that a current flows through the: workpiece surface, electrolytic medium, electrode and power source circuit.

On the other hand, the electropolishing method for WC/Co contemplates the following aspects:

An important element of the electropolishing process of WC/Co inorganic composite materials, is the type of current applied to the surface to be treated. In a particular embodiment, for example, when polishing WC/Co composite material, step D comprises at least two segments:

In segment D1 a variable voltage is applied comprising at least a time applying positive voltage and another time applying negative voltage to the workpiece surface. The current applied in segment D1 can be, as non-limiting examples, continuous, alternating, half-wave rectified alternating, full-wave rectified alternating, sawtooth, simple square wave, positive and negative double square wave, pulsed, positive and negative pulse train, among others.

The duration of segment D1 is between 0.01 and 5 seconds, preferably between 0.1 and 1 seconds.

Figure 2:
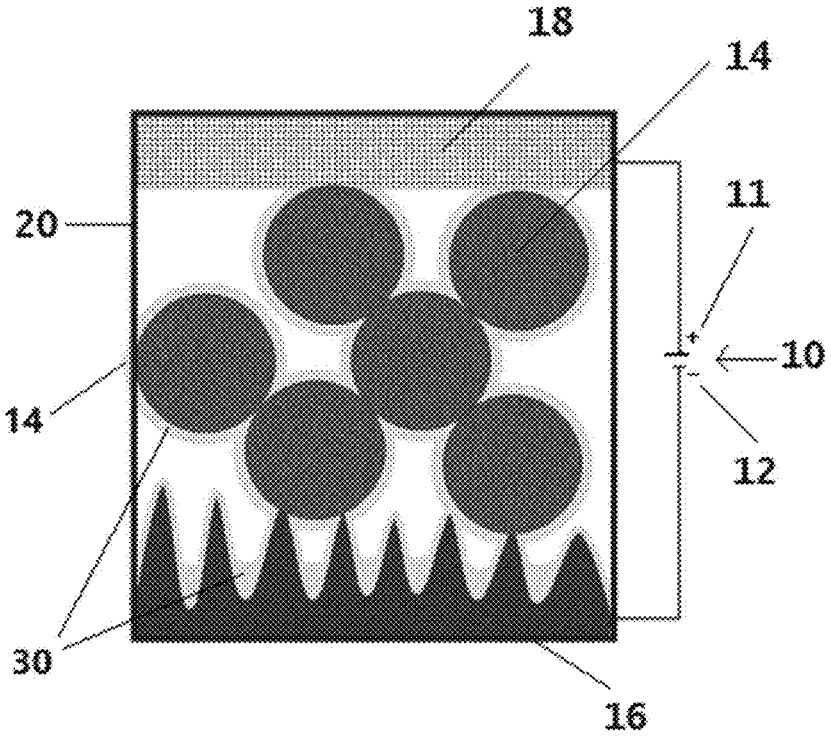
FIG. 2 shows a diagram of the electrolytic medium where solid particles covered by the non-conductive liquid can be observed, as well as the workpiece covered by the non-conductive liquid.

Preferably, the applied current is a square wave that can be divided into four times: a time t1 without applying voltage, a time t2 applying positive voltage to the workpiece surface, a time t3 without applying voltage, and a time t4 applying negative voltage to the workpiece surface, as shown schematically in FIG. 2. This is an idealized representation of a square wave, with the applied wave to the process being one that tends towards this representation. Times t1 and t3 can be zero, meaning it is possible to work without neutral voltage time.

A relevant, but not limiting example of the type of wave which can be applied for WC/Co polishing is a wave with a time t1 of 0.5 microseconds, a time t2 of 2 microseconds applying 18 V, a time t3 of 0.5 microseconds, and a 10 microseconds negative pulse at −50 V.

This stage can be subdivided into several sub-segments in which different electrical voltages are applied.

In segment D2 a voltage between zero and a negative value is applied to the workpiece surface, and a voltage between zero and a positive value is applied to the electrode, either constant or variable. The current applied in segment D2 can be, among others, a direct current, a filtered alternating current, a rectified alternating current, a pulsed current, square wave, etc.

For WC/Co polishing, preferably the duration of segment D2 is a minimum of 0.01 seconds and a maximum of 20 seconds. Preferably, segment D2 has a duration between 0.1 seconds and 10 seconds.

Figure 3:
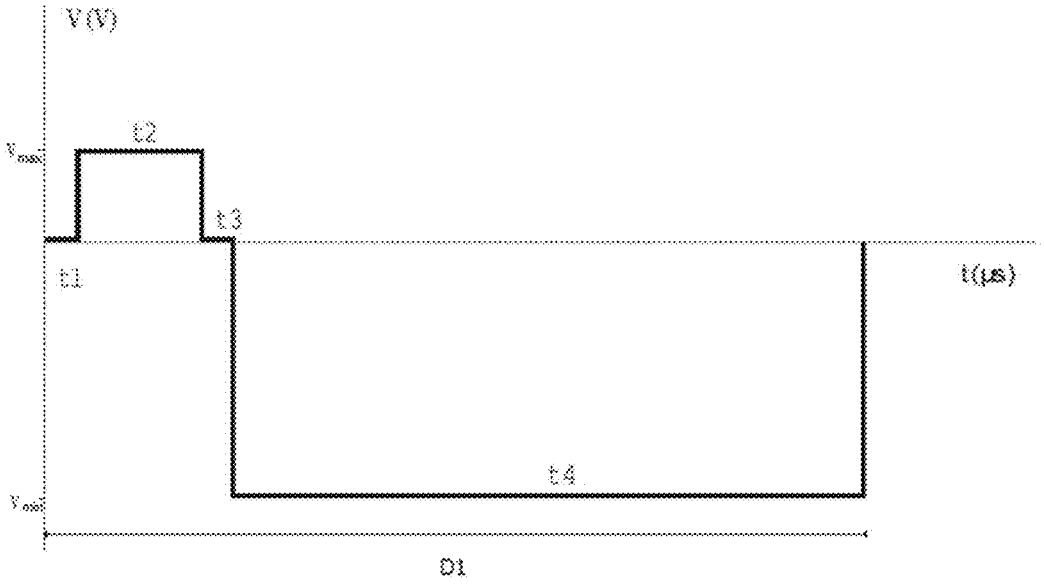
FIG. 3 shows a graph of the evolution of the applied current in a first segment D1 divided in four times for a workpiece surface to be surface finished, according to the method of the invention.
Figure 4:
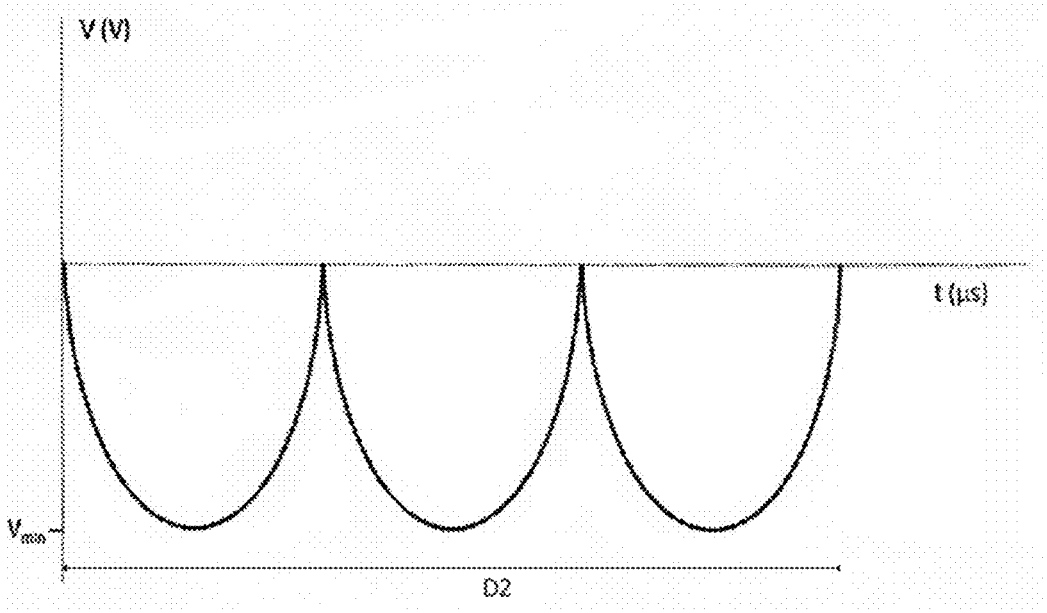
FIG. 4 shows a graph of the evolution of the rectified wave current applied to the workpiece surface in a second segment D2, according to the method of the invention.

Preferably, for WC/Co electropolishing, the current is rectified alternating, as shown in FIG. 3. For practicality, a wave with a frequency of 50 Hz can be used. The most negative value of this wave is preferably between −10 and −100 V.

Segments D1 and D2 alternate successively. In segment D1, an oxidation process occurs that is different in the ceramic tungsten carbide particles and the cobalt metal binder. In segment D2, these oxides are removed. Together, D1 and D2 produce a leveling effect on the surface.

This invention, which comprises an electrolytic medium and its electropolishing process methods, allows the treatment of inorganic composite materials that were previously impossible to treat or with better results. Of particular industrial relevance is the electropolishing of inorganic metal-ceramic composite materials such as WC/Co, metal-metal such as duplex steels, or ceramic-ceramic material such as PcBN/TiN.

The major advantage over the prior art is that by avoiding the preferential dissolution of the metal binder (leaching in inorganic composite materials), a homogeneous leveling effect in terms of roughness is achieved. By combining the restrictive geometric effect of the particles with the restrictive effect of the silicone, very low roughness can be achieved with minimal material removal.

This invention achieves specular finishes in high-added-value tools for drilling, cutting, die-making, etc.

According to the numbering adopted, it can be observed how in FIG. 1A a schematic representation of a metal-ceramic composite material (referenced as 1 and 2 respectively) with a certain initial roughness before a polishing process is shown.

Figure 1B:
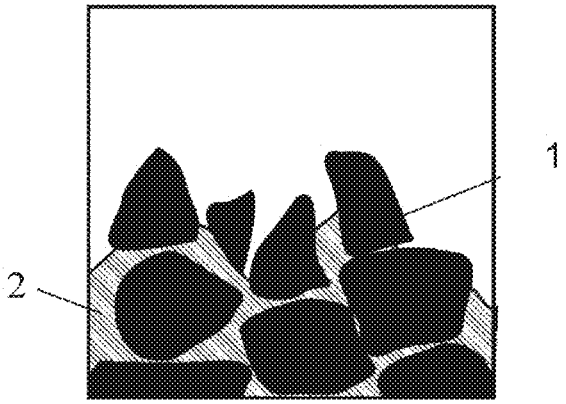
FIG. 1B is a schematic representation of the material shown in FIG. 1A after a conventional mechano-chemical or electropolishing process, which causes preferential dissolution of the metal binder (leaching)

Referring to FIG. 1B, the same composite material 1, 2 is observed after a mechano-chemical or conventional electropolishing process, which causes preferential dissolution of the metal binder (leaching).

Figure 1C:
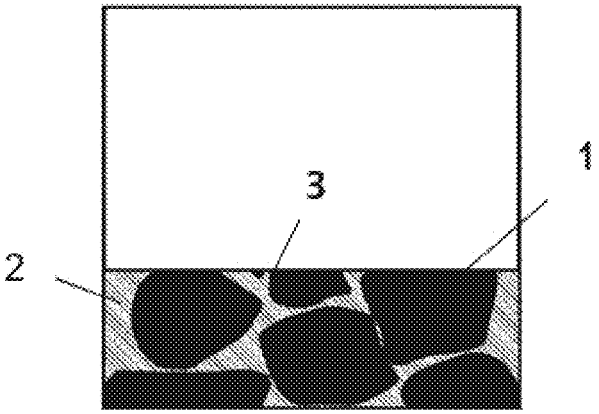
FIG. 1C is a schematic representation of the material shown in FIG. 1A after an electropolishing process according to the invention.

And, referring to FIG. 1C, the material 1, 2 is observed after an electropolishing process according to the invention, said process not causing leaching and producing a homogeneous leveling of the surface 3.

Specific examples are described below, one of an electrolytic medium and an electropolishing method with said medium. Specifically, an electrolytic medium for the electropolishing inorganic metal-ceramic composite materials.

In this embodiment, the solid particles capable of retaining liquid are ion exchange resin particles. Preferably, these particles are cation exchange resins and even more preferably, spheres of sulfonated styrene-divinylbenzene copolymer resin. Preferably, the spheres have a size distribution centered between 600 and 800 micrometers in diameter. The resin may have a macroporous or gel-like structure.

Preferably, before their use in the electropolishing process, the solid particles have been washed for removing the impurities soluble in distilled water.

Preferably, the solid particles are gel-type sulfonated styrene-divinylbenzene spheres that have been washed at 100° C. for 3 cycles with distilled water and dried to 27% mass of water relative to the total mass.

In this preferred embodiment, the non-conductive liquid is a liquid polydimethylsiloxane silicone with a viscosity of less than 5 cP. For example, a Cari Roth Silicone oil M 3 silicone (Viscosity (at 25° C.) of 2.7 cP, density (at 25° C.)

of 0.90 g/cm3, flash point greater than 62° C. and a flow point of −100° C.) or similar.

The solid particles are admixed with the liquid silicone. Preferably, the mixture undergoes through a process for obtaining a homogeneous distribution of silicone over the surface of the particles.

The amount of silicone added to the particles may vary depending on different process parameters, such as the dimensions and shape of the workpiece to be polished. As a general indicative guideline, 10 g of silicone are added to 1 kg of this resin.

| | % Wt | | |
|---|---|---|---|
| | Optimal | Minimum | Maximum |
| Solid ion exchange resin particles | 80-70 | 45 | 80 |
| Distilled water | 20-30 | 20 | 55 |
| Silicon: polydimethylsiloxane | 0.5-5 | 0.01 | 10 |

The following discloses a method for the electropolishing of inorganic metal-ceramic composite materials.

The current applied for the electropolishing of inorganic metal-ceramic composite materials can be divided into two segments D1 and D2.

Segment D1 has a duration between 0.01 and 5 seconds, preferably between 0.1 and 1 seconds. Preferably, in this segment, a square wave current is applied that can be divided into four times. The preferred maximum and minimum voltages applied in this segment are indicated in the following table.

| | | Duration | | | Voltage | | |
|---|---|---|---|---|---|---|---|
| Segment | Time | Optimal | Minimum | Maximum | Optimal | Minimum | Maximum |
| D1 | | 0.1-1 s | 0.01 s | 5 s | | | |
| | T1 | 0.1-1 μs | 0 μs | 100 μs | 0 | 0 | 0 |
| | T2 | 1-10 μs | 1 μs | 100 μs | (+5)-(+50) V | (+5) V | (+100) V |
| | T3 | 0.1-1 μs | 0 μs | 100 μs | 0 | 0 | 0 |
| | T4 | 5-50 μs | 1 μs | 100 μs | (−25)-(−75) V | (−10) V | (−250) V |
| D2 | | 0.1-10 s | 0.01 s | 20 s | (−10)-(−100) V | 0 | (−250) V |

Segment D2 has a duration of 0.01 to 20 seconds, preferably between 0.1 and 10 seconds. In this segment, a voltage is applied to the workpiece that can vary between zero and a certain negative value, preferably between −10 and −100 V.

In a preferred embodiment, this current is a rectified alternating current that reaches a more negative value between −10 and −100 V. A wave with a frequency of 50 Hz can be used, although this frequency can vary by several orders of magnitude and still produce positive effects.

For example, for WC/Co electropolishing, a wave with D1 with a t1 time of 0.5 microseconds, a t2 time of 2 microseconds applying 18 V, a t3 time of 0.5 microseconds, and a negative pulse of 10 microseconds at −50 V can be applied; and a D2 time that is a rectified alternating wave of 50 Hz at −50 V.

Finally, it should be noted that, according to FIG. 2, an example of a graphical representation of an applied current in time D1 is observed: square wave current that can be divided into four times: a time t1 without applying voltage, a time t2 applying positive voltage to the workpiece surface, a time t3 without applying voltage and a time t4 applying negative voltage to the workpiece surface.

On the other hand, in FIG. 3, an example of a graphical representation of an applied current in time D2 is observed with rectified wave current.

The following clauses disclose additional embodiments.

Clause 1. Solid electrolytic medium for electropolishing of conductive inorganic composite materials metal-metal, ceramic-ceramic, and metal-ceramic, comprising:

a set of solid particles with the ability to retain a liquid, an amount of water retained in the solid particles, and a non-conductive immiscible liquid covering the solid particles, so that when two solid particles contact, or when a solid particle contact the surface of the workpiece to be treated, the non-conductive liquid is displaced, allowing electrical conductivity between solid particles or between the solid particle and the workpiece to be polished.

Clause 2. Electrolytic medium for electropolishing, according to clause 1, wherein the non-conductive liquid partially coats the workpiece to be polished.

Clause 3. Electrolytic medium for electropolishing, according to any of the preceding clauses, wherein the non-conductive liquid comprises a liquid silicone.

Clause 4. Electrolytic medium for electropolishing, according to any of the preceding clauses, wherein the non-conductive liquid viscosity is between 1 and 20 cP at 25° C.

Clause 5. Electrolytic medium for electropolishing, according to any of the preceding clauses, wherein the mass proportions are:

solid particles from 45 to 80% Wt water from 20 to 55% Wt non-conductive liquid from 0.01 to 10% Wt Clause 6. Electrolytic medium for electropolishing, according to any of the preceding clauses, wherein the solid particles comprise ion exchange resin, cationic, anionic, or chelating.

Clause 7. Electrolytic medium for electropolishing, according to clause 6, wherein the ion exchange resin comprises a copolymer of styrene and sulfonated divinylbenzene.

Clause 8. Electrolytic medium for electropolishing, according to any of the preceding clauses, wherein the solid particles are spherical with a diameter distribution centered between 0.05 and 1 mm.

Clause 9. Electropolishing method with an electrolytic medium as described on clauses 1 to 8, where the dry electropolishing method for conductive inorganic composite materials metal-metal, ceramic-ceramic, and metal-ceramic, comprises:

A. Providing electrical connectivity with a power supply to a workpiece surface to be treated and the electrolytic medium by an electrode, B. To contact the workpiece surface against an electrolytic medium, as described in clauses 1 to 8, C. Producing relative movement between the workpiece surface and solid electrolyte particles, D. Applying one or more potential differences between the workpiece surface and a counter electrode in the power supply, such that a current flows in the workpiece surface, the electrolytic medium, the electrode and the power supply circuit.

Clause 10. Electropolishing method, according to clause 9, wherein stage D comprises the following sub-stages:

D1—Applying a variable voltage comprising at least a time applying positive voltage and another time applying negative voltage to the workpiece surface; and D2—Applying to the workpiece surface a voltage between zero and a negative value, and to the counter electrode a voltage between zero and a positive value, either constant or variable.

Clause 11. Electropolishing method, according to clause 10, wherein stage D1 lasts between 0.01 and 5 seconds, and a waveform applied is subdivided into four times:

t1 with zero voltage and duration of 0.1 to 100 microseconds;

t2 with voltage from +5 to +100 V and duration of 1 to 100 microseconds;

t3 with zero voltage and duration of 0.1 to 100 microseconds; and t4 with voltage from −10 to −250 V and duration of 1 to 100 microseconds.

Clause 12. Electropolishing method, according to clause 10, wherein stage D2 lasts between 0.01 and 10 seconds, and a rectified alternating negative current is applied.

What is claimed is:

1. An electrolytic medium for electropolishing a workpiece made of a conductive inorganic composite material, the electrolytic medium comprising:

solid particles that each retains a liquid comprising distilled water; and an electrically non-conductive immiscible liquid covering each of the solid particles in which is retained the distilled water, the electrically non-conductive immiscible liquid being displaceable on the solid particles to allow electrical conductivity between solid particles that contact one another and to allow electrical conductivity between the solid particles and the workpiece upon the solid particles contacting a surface of the workpiece.

2. The electrolytic medium according to claim 1, wherein the electrically non-conductive immiscible liquid is in an amount sufficient to at least partially coat the surface of the workpiece.

3. The electrolytic medium according to claim 1, wherein the electrically non-conductive immiscible liquid comprises a liquid silicone.

4. The electrolytic medium according to claim 1, wherein the electrically non-conductive immiscible liquid viscosity is between 1 and 20 cP at 25° C.

5. The electrolytic medium according to claim 3, wherein the electrically non-conductive immiscible liquid viscosity is between 1 and 20 cP at 25° C.

6. The electrolytic medium according to claim 1, wherein each of the solid particles comprise an ion exchange resin.

7. The electrolytic medium according to claim 6, wherein the ion exchange resin comprises a copolymer of styrene and sulfonated divinylbenzene.

8. The electrolytic medium according to claim 1, wherein the solid particles have a diameter distribution between 0.05 and 1 mm.

9. The electrolytic medium according to claim 1, wherein the liquid retained in the solid particles has an electrical conductivity below 10 μS/cm.

10. A method for electropolishing a surface of a workpiece made of a conductive inorganic composite material, the method comprising:

contacting the surface of the workpiece against an electrolytic medium that comprises solid particles that each has retained therein a liquid comprising distilled water, each of the solid particles retaining the liquid being covered by an electrically non-conductive immiscible liquid;

electrically connecting the workpiece to a first pole of an electrical power supply and electrically connecting the electrolytic medium to a second pole of the power supply, the first and second poles having opposite polarity; and producing relative movement between the surface of the workpiece and the solid particles of the electrolytic medium.

11. The method according to claim 10, wherein the first pole is a negative pole and the second pole is a positive pole.

12. The method according to claim 10, wherein the electrolytic medium is electrically connected to an electrode that is electrically coupled to the second pole of the power supply such that current flows through the electrode to the electrolytic medium and then from the electrolytic medium through the workpiece.

13. The method according to claim 10, wherein the conductive inorganic composite material is selected from the group consisting of: a metal-metal composite material, a ceramic-ceramic composite material, and a metal-ceramic composite material.

14. The method, according to claim 10, wherein during electropolishing a positive voltage and a negative voltage are alternatingly applied to the workpiece.

15. The method according to claim 14, wherein during a first time interval the positive voltage is applied to the workpiece and during a second time interval the negative voltage is applied to the workpiece.

16. The method according to claim 14, wherein during a first time interval no voltage is applied to the workpiece for a duration of 0.1 to 100 microseconds, during a second time interval after the first time interval +5 to +100 volts is applied to the workpiece for a duration of 1 to 100 microseconds, during a third time interval after the second time interval no voltage is applied to the workpiece for a duration of 0.1 to 100 microseconds, and during a fourth time interval after the third time interval −10 to −250 volts is applied to the workpiece for a duration of 1 to 100 microseconds.

17. The method according to claim 15, wherein the positive voltage is applied to the workpiece at a constant rate during the first time interval and the negative voltage is applied to the workpiece at a constant rate during the second time interval.

18. The method according to claim 15, wherein the positive voltage is applied to the workpiece at a variable rate during the first time interval.

19. The method according to claim 15, wherein the negative voltage is applied to the workpiece at a variable rate during the second time interval.

20. The method according to claim 19, wherein the positive voltage is applied to the workpiece at a variable rate during the first time interval.

* * * * *